US006035920A

United States Patent [19]

Lassen et al.

[11] Patent Number: 6,035,920

[45] Date of Patent: Mar. 14, 2000

[54] SCREENING ARRANGEMENT

[75] Inventors: Gert Godvig Lassen; Jesper Østergaard Kristensen, both of Skjern, Denmark

[73] Assignee: V. Kann Rasmussen Industri A/S, Soborg, Denmark

[21] Appl. No.: 09/065,066

[22] PCT Filed: Sep. 30, 1996

[86] PCT No.: PCT/DK96/00412

§ 371 Date: Apr. 27, 1998

§ 102(e) Date: Apr. 27, 1998

[87] PCT Pub. No.: WO97/18378

PCT Pub. Date: May 22, 1997

[30] Foreign Application Priority Data

Nov. 15, 1995 [DK] Denmark ..... 1276/95

[51] Int. Cl.[7] ..... E06B 9/327

[52] U.S. Cl. ..... 160/172 R; 160/107

[58] Field of Search ..... 160/172 R, 265, 160/107, 189, 84.01, 192, 23.1

[56] References Cited

U.S. PATENT DOCUMENTS

| | | | |
|---|---|---|---|
| 3,061,006 | 10/1962 | Hazlett | 160/265 |
| 4,707,018 | 11/1987 | Gavagan | 160/23.1 X |
| 4,825,921 | 5/1989 | Rigter | 160/23.1 |
| 5,113,922 | 5/1992 | Christensen et al. | 160/172 R |
| 5,301,733 | 4/1994 | Toti | 160/84.01 |

FOREIGN PATENT DOCUMENTS

| | | |
|---|---|---|
| 1 683 026 | 12/1969 | Germany . |
| 2906871C2 | 9/1980 | Germany . |

*Primary Examiner*—David M. Purol
*Attorney, Agent, or Firm*—Lane, Aitken & McCann, L.L.P.

[57] ABSTRACT

The screening arrangement, in particular a Venetian blind, is intended for installation in a roof window and comprises a screening length having a number of mutually connected elements as well as profile lists to be mounted on each of the side members of the sash and each having a track for receiving a structure displaceable along the track, the structure comprising a spring housing and a slide shoe. The slide shoe is provided with an abutment surface for the elements of the screening length during their gathering during raising of the screening arrangement. A bottom list of the screening length facing the bottom member of the frame is connected at each end with the displaceable structure and loaded in the direction of the bottom member of the sash by a coil spring rotatably mounted in the spring housing, the uncoiled portion of the spring extending in the track in question from the displaceable structure to a fixing point at the bottom member of the sash. The abutment surface of the slide shoe extends in the longitudinal direction of the track to such an extent that it may receive a predetermined number of screening elements, and the spring housing and the slide shoe are displaceable relative to each other in view to reducing the extension of the abutment surface. The spring housing may for instance be guided in a track in the slide shoe.

8 Claims, 2 Drawing Sheets

SCREENING ARRANGEMENT

BACKGROUND OF THE INVENTION

The present invention relates to a screening arrangement, in particular a Venetian blind, for installation in a roof window with a sash comprising a top member, a bottom member and two side members, which screening arrangement comprises a screening length having a number of mutually connected elements as well as profile lists to be mounted on each of the side members of the sash and each having a track for receiving a means displaceable along the track, said means comprising a spring housing and a slide shoe with an abutment surface for said elements of the screening length during their gathering through raising of the screening arrangement, in which a bottom list of the screening length facing the bottom member of the sash at each end is connected with the displaceable means and loaded in the direction of the bottom piece of the sash by a coil spring rotatably mounted in the spring housing, the uncoiled portion of which extending in the track in question from the displaceable means to a fixing point at the bottom member of the sash.

A screening arrangement of this type is known from DK published specification No. 160 627. Such screening arrangements are used in windows of many different sizes and thus have a differing number of screening elements. It is therefore necessary to produce the slide shoes of the displaceable means with different lengths depending on the length of the screening arrangement. This entails in addition to the drawbacks of a purely technical nature in connection with the manufacture also a higher price of the screening arrangement as a whole.

SUMMARY OF THE INVENTION

It is the object of the present invention to improve a screening arrangement of the type mentioned by way of introduction such that one and the same displaceable means may be used in screening arrangements of any length.

This object is met by means of a screening arrangement which is characterized in that the abutment surface of the slide shoe extends in the longitudinal direction of the track to such an extent that it may receive a predetermined number of screening elements, and that the spring housing and the slide shoe are displaceable relative to each other in view of reducing the extension of the abutment surface.

In this way, the displaceable means may be manufactured as a standardized unit, in which the slide shoe has an abutment surface which is so dimensioned that it may receive all screening elements of even very long screening arrangements. By letting the spring housing be displaceable relative to the slide shoe it now becomes possible to bring the upper elements of shorter screening arrangements, which would not otherwise be raised, into abutment against already raised elements, the spring housing and the bottom list continuing their movement in the direction towards the top member of the sash, even though the slide shoe has reached its end position.

The displaceable connection between the spring housing and the slide shoe is in an embodiment, which from a constructional point of view is very simple, established by the spring housing being guided in a rack in the slide shoe.

BRIEF DESCRIPTION OF THE DRAWINGS

The invention will be explained in detail in the following by means of an example of an embodiment and with reference to the schematic drawing, in which.

DETAILED DESCRIPTION OF THE PREFERRED EMBODIMENTS

Figure 1:
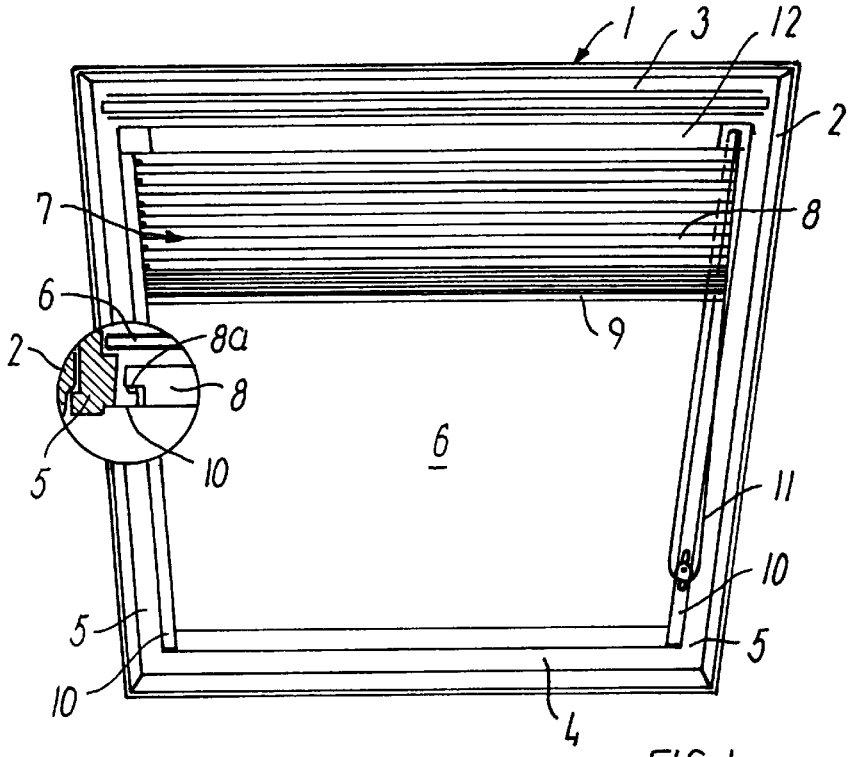
FIG. 1 shows a roof window with a screening arrangement according to the invention, including an enlarged cross-section of a side member of the roof window, FIG. 2 a perspective view of a detail of the screening arrangement according to the invention, FIGS. 3 and 4 lateral views, partially sectional, of the screening arrangement according to the invention, the screening elements being raised partially and completely, respectively, and FIG. 5 a sectional view along the line V—V in FIG. 4.

FIG. 1 shows a roof window 1 with a frame 2 and a sash hingedly connected therewith, said sash comprising a top member 3, a bottom member 4 and two side members 5 carrying a window pane 6. At the inside of the pane 6 a screening arrangement 7 is installed, which in the embodiment shown is a Venetian blind, but which also for instance might be an exterior roller shutter or a folding blind. The Venetian blind 7 is provided with screening elements 8 in the form of slats and ends in the lower end, i.e. the end facing the bottom member 4 of the sash, in a bottom list 9. The bottom list 9 is guided in a way not shown in detail in FIG. 1 profile lists 10 mounted on the side members 5 of the sash the side members likewise guiding the slats 8 through recesses 8*a* in the slats. The positioning of the profile lists 10 also appear from the detailed cross-sectional portion of FIG. 1. The Venetian blind 7 is operated, i.e. the raising and lowering thereof as well as adjustment of the inclination of the slats, by means of a cord 11 which is guided to a driving device, not shown in detail, which is placed in a top box 12 fastened to the top member 3 of the sash, said box accommodating among others the cords of the Venetian blind. Operation may also be carried out by means of an electric driving device of a type known per se.

Figure 2:
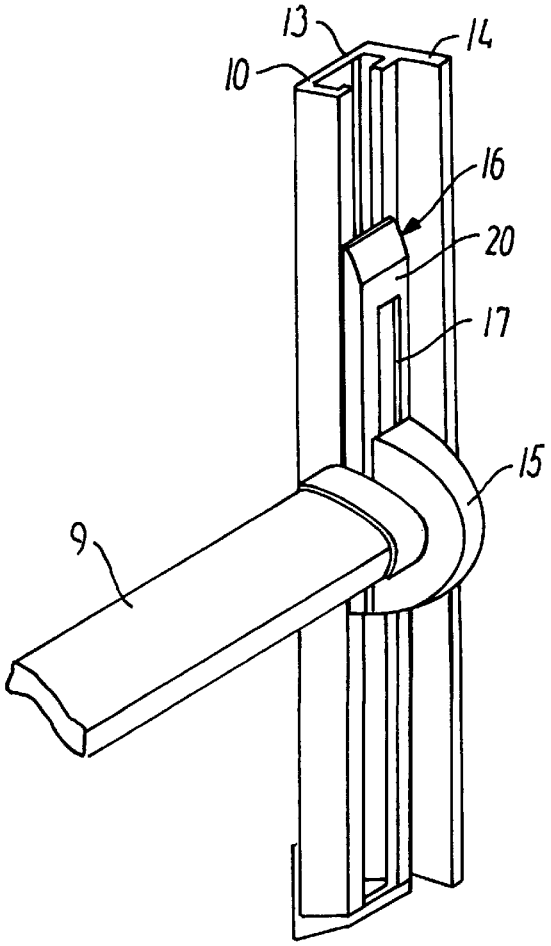

As shown in FIG. 2 each profile list 10 has a track 13 with an opening which in the mounted position of the screening arrangement faces the window pane 6. The profile list 10 is in view of being fastened to the side member 5 of the sash provided with a flange 14. In FIG. 2 the profile list 10 is intended for being mounted on the sash side member, which in FIG. 1 is the left one, and the profile list for the opposite side member is relative thereto mounted reversely.

Figure 3:
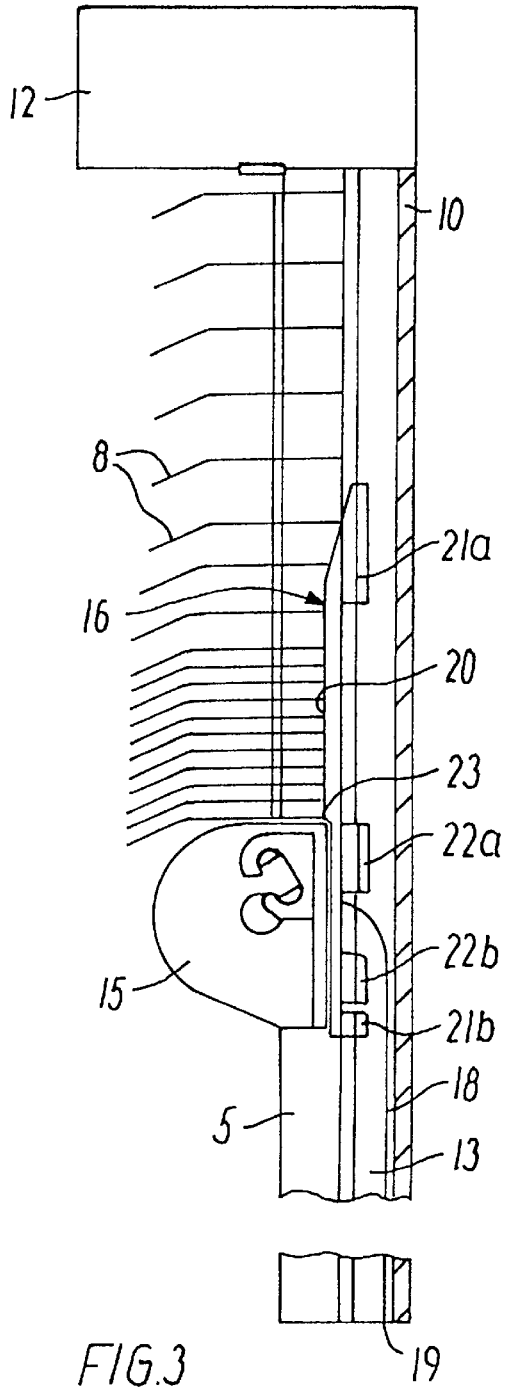
Figure 4:
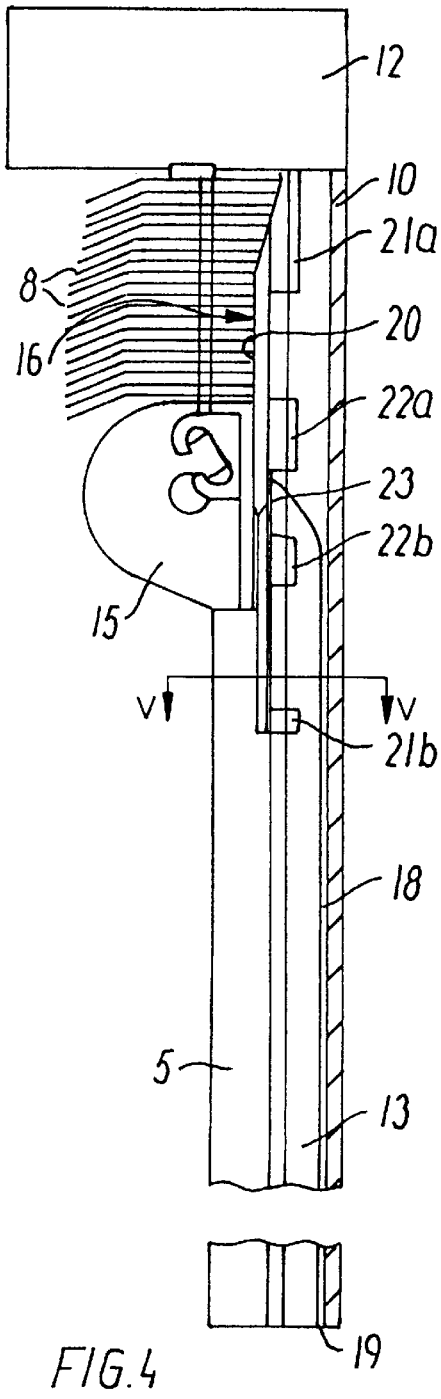
Figure 5:
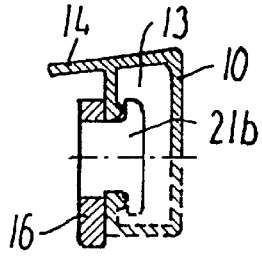

A slidable means comprising a spring housing 15 and a slide shoe 16 is placed in connection with the track 13. The displaceable connection between the slide shoe 16 and the track 13 is established thereby that the slide shoe at its bottom side, i.e. the side facing the track 13, as shown in FIGS. 3 and 4, is provided with projections 21*a* and 21*b*, which seen in the cross-sectional direction of the track have the form of a reversed T in engagement with the track 13, which appears most clearly from FIG. 5. The bottom list 9 of the Venetian blind is at each end seated in the spring housing 15, which in turn by means of a track 17 in the slide shoe 16 is displaceably guided therein. The spring housing 15 is in the same manner as the slide shoe 16 provided with projections 22*a* and 22*b* at its bottom side, said projections being guided through the track 17 in the slide shoe 16 and the track 13 of the profile list 10.

The spring housing 15 accommodates a rotatably mounted coil spring, the coiled portion of which is positioned in the spring housing itself, and the uncoiled portion 18 of which, shown in FIGS. 3 and 4, extends in the track 13 of the profile list 10 down to a fastening point 19 at the lower end of the profile list 10. In this way the spring housing 15 and consequently the slide shoe 16 and the bottom list 9 of the Venetian blind get in the mounted position spring-loaded in the direction towards the bottom member of the sash. Without this spring-loading it would not be possible to lower the Venetian blind completely in respect of windows which are mounted in roofs having a slight inclination.

The functioning of the displaceable means appears from FIGS. 3 and 4. In FIG. 3 the Venetian blind is partially raised, and the lower slats are gathered and abut an abutment surface 20 on the slide shoe 16. On account of the friction between the spring housing and the slide shoe and/or as shown a shoulder portion 23 on the slide shoe 16, the spring housing 15 remains in the lower part of the track 17 in the slide shoe 16. Therefore, the spring housing 15 and the slide shoe 16 move upwards together in the track 13 of the profile list 10. The raising continues in this manner, the slats being gathered until the upper end of the slide shoe 16 touches the top box 12. The slide shoe 16 is now in its upper end position, and gathering of the last, i.e. the upper slats, takes place thereby that the spring housing 15 is displaced in the direction towards the top box 12 in the track 17 in the slide shoe 16, until all slats abut each other.

We claim:

1. The combination of a roof window (1) having a sash comprising a top member (3), a bottom member (4) and two side members (5); and a screening arrangement installed in the roof window, wherein the screening arrangement comprises:

a screening length having a number of mutually connected elements and a bottom list;

profile lists (10) to be mounted on each of the side members of the sash, each profile list having a track (13) and an end adapted to be positioned adjacent to the bottom member of the sash, said track having a longitudinal direction adapted to extend along one of the side members of the sash;

a structure received by and displaceable along the track, said structure comprising a spring housing (15), a coil spring rotatably mounted in the spring housing, a slide shoe (16) having an abutment surface (20) for abutting said elements (8) of the screening length during their gathering through raising of the screening arrangement, and a mounting structure mounting said spring housing on said slide shoe for movement relative to said slide shoe in the longitudinal direction of said track, the bottom list (9) of the screening length being connected at each end with a respective one of the displaceable structures and being loaded in the direction of said end of said profile list by the coil spring, the coil spring having an uncoiled portion (18) extending in the track (13) from the displaceable structure to a fixing point at said end of said profile list, the abutment surface (20) of the slide shoe (16) extending in the longitudinal direction of the track (13) sufficiently to receive a predetermined number of screening elements (8), wherein said mounting structure comprises a track in the slide shoe, the sprint housing being guided in said track in the slide shoe.

2. The combination according to claim 1, characterized by means for holding the spring housing (15) stationary at an end of the slide shoe (16) facing said end of said profile list during the raising of the screening arrangement.

3. The combination according to claim 2, characterized in that said means for holding comprises a shoulder portion (23) on the slide shoe (16).

4. The combination according to claim 1, wherein said mounting structure is a mounting structure slidably mounting said spring housing on said slide shoe for sliding movement relative to said slide shoe, providing an additional displacement of said spring housing relative to said track.

5. The combination according to claim 1, wherein said mounting structure comprises a mounting structure mounting said spring housing on said slide shoe for movement of the entire spring housing relative to the slide shoe.

6. The combination of a roof window (1) having a sash comprising a top member (3), a bottom member (4) and two side members (5); and a screening arrangement installed in the roof window, wherein the screening arrangement comprises:

a screening length having a number of mutually connected elements and a bottom list;

profile lists (10) mounted on each of the side members of the sash, each of said profile lists having a track (13) and an end positioned adjacent to the bottom member of the sash, each of said tracks having a longitudinal direction extending along one of the side members of the sash;

two slidable structures received by and displaceable along the tracks, each of said slidable structures comprising a spring housing (15), a coil spring rotatably mounted in the spring housing, a slide shoe (16) having an abutment surface (20) for abutting said elements (8) of the screening length during their gathering through raising of the screening arrangement, and track means for slidably mounting said spring housing on said slide shoe for movement relative to said slide shoe in the longitudinal direction of said tracks, wherein the bottom list (9) of the screening length is connected at each end with a respective one of the slidable structures and is loaded in the direction of said end of said lists by the coil springs, the coil springs having an uncoiled portion (18) extending in the tracks (13) from the slidable structures to a fixing point at said end of said profile lists, the abutment surface (20) of the slide shoes (16) extending in the longitudinal direction of the tracks (13) sufficiently to receive a predetermined number of screening elements (8).

7. The combination according to claim 6, wherein said means for mounting comprises means for slidably mounting said spring housing on said slide shoe for sliding movement relative to said slide shoe and for providing an additional displacement of said spring housing relative to said track.

8. The combination according to claim 6, wherein said means for mounting comprises means for mounting said spring housing on said slide shoe for movement of the entire spring housing relative to said slide shoe.

* * * * *